US006576602B1

(12) United States Patent
Smerznak et al.

(10) Patent No.: US 6,576,602 B1
(45) Date of Patent: Jun. 10, 2003

(54) NONAQUEOUS, PARTICULATE-CONTAINING LIQUID DETERGENT COMPOSITIONS WITH SURFACTANT-STRUCTURED LIQUID PHASE

(75) Inventors: Mark Allen Smerznak, Cincinnati, OH (US); Walter A. M. Broeckx, Zele (BE); Iwein J. M. J. Goderis, Boortmeerbeek (BE); Roger J. Jones, Jauche (BE); Diane Parry, Cincinnati, OH (US); Jay I. Kahn, Cincinnati, OH (US); Jean Wevers, Steenhuffel (BE)

(73) Assignee: The Procter & Gamble Company, Cincinnati, OH (US)

( * ) Notice: Subject to any disclaimer, the term of this patent is extended or adjusted under 35 U.S.C. 154(b) by 818 days.

(21) Appl. No.: 08/881,457

(22) Filed: Jun. 24, 1997

Related U.S. Application Data

(60) Provisional application No. 60/020,504, filed on Jun. 28, 1996.

(51) Int. Cl.[7] ..... C11D 1/02

(52) U.S. Cl. ..... 510/407; 510/371

(58) Field of Search ..... 510/304, 338, 510/407, 413, 415, 418, 369, 371, 372, 375, 309, 311, 312, 313, 314, 374, 376, 378

(56) References Cited

U.S. PATENT DOCUMENTS

| | | | | | |
|---|---|---|---|---|---|
| 3,630,929 | A | * | 12/1971 | Van Dijk | 252/136 |
| 4,253,993 | A | * | 3/1981 | Ramsey, III et al. | 252/548 |
| 4,316,812 | A | * | 2/1982 | Hancock et al. | 252/99 |
| 4,622,173 | A | * | 11/1986 | Broze et al. | 252/528 |
| 4,648,983 | A | * | 3/1987 | Broze et al. | 252/135 |
| 4,690,771 | A | * | 9/1987 | Ouhadi et al. | 252/102 |
| 4,744,916 | A | * | 5/1988 | Adams et al. | 252/99 |
| 4,753,750 | A | * | 6/1988 | Ouhadi et al. | 252/139 |
| 4,772,413 | A | * | 9/1988 | Massaux et al. | 252/102 |
| 4,781,856 | A | * | 11/1988 | Ouhadi et al. | 252/174.19 |
| 4,789,496 | A | * | 12/1988 | Broze et al. | 252/99 |
| 4,797,225 | A | * | 1/1989 | Broze et al. | 252/105 |
| 4,828,723 | A | * | 5/1989 | Cao et al. | 252/8.8 |
| 4,846,992 | A | * | 7/1989 | Fonsny | 252/90 |
| 4,873,012 | A | * | 10/1989 | Broze et al. | 252/99 |
| 4,874,537 | A | * | 10/1989 | Peterson et al. | 252/99 |
| 4,886,615 | A | * | 12/1989 | Dehan | 252/90 |
| 4,889,652 | A | * | 12/1989 | Sullivan et al. | 252/99 |
| 4,919,834 | A | * | 4/1990 | Chen et al. | 252/90 |
| 4,929,380 | A | * | 5/1990 | Schulz et al. | 252/121 |
| 4,931,195 | A | * | 6/1990 | Cao et al. | 252/8.8 |
| 4,981,606 | A | * | 1/1991 | Barnes | 252/95 |
| 4,988,462 | A | * | 1/1991 | Schepers et al. | 252/174.22 |
| 5,114,620 | A | * | 5/1992 | Garvey et al. | 252/558 |
| 5,176,713 | A | * | 1/1993 | Dixit et al. | 8/137 |
| 5,368,767 | A | * | 11/1994 | Donker et al. | 252/95 |
| 5,389,284 | A | * | 2/1995 | Van Der Hoeven et al. | 252/174.22 |
| 5,441,661 | A | * | 8/1995 | Beaujean et al. | 252/95 |
| 5,456,849 | A | * | 10/1995 | Houghton et al. | 252/95 |
| 5,468,418 | A | * | 11/1995 | Rabone | 252/174.25 |
| 5,503,765 | A | * | 4/1996 | Schepers et al. | 252/95 |
| 5,512,206 | A | * | 4/1996 | Steltenkamp et al. | 252/186.4 |
| 5,633,223 | A | * | 5/1997 | Vasudevan et al. | 510/303 |
| 5,698,507 | A | * | 12/1997 | Gorlin et al. | 510/223 |
| 5,714,449 | A | * | 2/1998 | Donker et al. | 510/304 |

FOREIGN PATENT DOCUMENTS

| | | | | |
|---|---|---|---|---|
| EP | 266199 | * | 10/1987 | |
| EP | 0 266 199 A2 | | 10/1987 | C11D/1/72 |
| EP | 0 510 762 A2 | | 4/1992 | C11D/17/00 |
| EP | 510762 | * | 4/1992 | |
| EP | 565017 | * | 4/1993 | |
| FR | 2735786 | * | 12/1996 | |
| GB | 2302548 | * | 1/1997 | |
| WO | 91/13139 | * | 9/1991 | |
| WO | 92/02610 | * | 2/1992 | |
| WO | WO 92/02610 | | 2/1992 | C11D/17/00 |
| WO | 92/09678 | * | 6/1992 | |
| WO | WO 92/09678 | | 6/1992 | C11D/17/00 |
| WO | 95/06108 | * | 3/1995 | |
| WO | 96/10072 | * | 4/1996 | |
| WO | WO 96/10072 | | 4/1996 | C11D/17/00 |
| WO | WO 97/00938 | | 1/1997 | C11D/17/00 |
| WO | 97/00938 | * | 1/1997 | |

* cited by examiner

*Primary Examiner*—Gregory E. Webb
(74) *Attorney, Agent, or Firm*—Armina E. Matthews; Kim William Zerby; Steven W. Miller

(57) ABSTRACT

Disclosed are nonaqueous, particulate-containing liquid laundry detergent compositions which are in the form of a suspension of particulate material, preferably including peroxygen bleaching agent and an organic detergent builder, dispersed in a liquid phase structured with alkylbenzene sulfonate anionic surfactant-containing powder. Such compositions provide especially desirable cleaning and bleaching of fabrics laundered therewith and also exhibit especially desirable pourability and chemical and phase stability.

17 Claims, No Drawings

NONAQUEOUS, PARTICULATE-CONTAINING LIQUID DETERGENT COMPOSITIONS WITH SURFACTANT-STRUCTURED LIQUID PHASE

CROSS REFERENCE

The present case claims the benefit of U.S. Provisional Application No. 60/020,504, filed on Jun. 28, 1996, under 35 U.S.C. §119(e).

FIELD OF THE INVENTION

This invention relates to liquid laundry detergent products which are nonaqueous in nature and which are in the form of stable dispersions of particulate material such as bleaching agents and/or other detergent composition adjuvants.

BACKGROUND OF THE INVENTION

Liquid detergent products are often considered to be more convenient to use than are dry powdered or particulate detergent products. Liquid detergents have therefore found substantial favor with consumers. Such liquid detergent products are readily measurable, speedily dissolved in the wash water, capable of being easily applied in concentrated solutions or dispersions to soiled areas on garments to be laundered and are non-dusting. They also usually occupy less storage space than granular products. Additionally, liquid detergents may have incorporated in their formulations materials which could not withstand drying operations without deterioration, which operations are often employed in the manufacture of particulate or granular detergent products.

Although liquid detergents have a number of advantages over granular detergent products, they also inherently possess several disadvantages. In particular, detergent composition components which may be compatible with each other in granular products may tend to interact or react with each other in a liquid, and especially in an aqueous liquid, environment. Thus such components as enzymes, surfactants, perfumes, brighteners, solvents and especially bleaches and bleach activators can be especially difficult to incorporate into liquid detergent products which have an acceptable degree of chemical stability.

One approach for enhancing the chemical compatibility of detergent composition components in liquid detergent products has been to formulate nonaqueous (or anhydrous) liquid detergent compositions. In such nonaqueous products, at least some of the normally solid detergent composition components tend to remain insoluble in the liquid product and hence are less reactive with each other than if they had been dissolved in the liquid matrix. Nonaqueous liquid detergent compositions, including those which contain reactive materials such as peroxygen bleaching agents, have been disclosed for example, in Hepworth et al., U.S. Pat. No. 4,615,820, Issued Oct. 17, 1986; Schultz et al., U.S. Pat. No. 4,929,380, Issued May 29, 1990; Schultz et al., U.S. Pat. No. 5,008,031, Issued Apr. 16, 1991; Elder et al., EP-A-030,096, Published Jun. 10, 1981; Hall et al., WO 92/09678, Published in,; Jun. 11, 1992 and Sanderson et al., EP-A-565,017, Published Oct. 13, 1993.

Even though chemical compatibility of components may be enhanced in nonaqueous liquid detergent compositions, physical stability of such compositions may become a problem. This is because there is a tendency for such products to phase separate as dispersed insoluble solid particulate material drops from suspension and settles at the bottom of the container holding the liquid detergent product. As one consequence of this type of problem, there can also be difficulties associated with incorporating enough of the right types and amounts of surfactant materials into nonaqueous liquid detergent products. Surfactant materials must, of course, be selected such that they are suitable for imparting acceptable fabric cleaning performance to such compositions but utilization of such materials must not lead to an unacceptable degree of composition phase separation. Phase stabilizers such as thickeners or viscosity control agents can be added to such products to enhance the physical stability thereof. Such materials, however, can add cost and bulk to the product without contributing to the laundering/cleaning performance of such detergent compositions.

It is also possible to select surfactant systems for such liquid laundry detergent products which can actually impart a structure to the liquid phase of the product and thereby promote suspension of particulate components dispersed within such a structured liquid phase. An example of such a product with a structured surfactant system is found in van der Hoeven et al.; U.S. Pat. No. 5,389,284; Issued Feb. 14, 1995, which utilizes a structured surfactant system based on relatively high concentrations of alcohol alkoxylate nonionic surfactants and anionic defloculating agents. In products which employ a structured surfactant system, the structured liquid phase must be viscous enough to prevent settling and phase separation of the suspended particulate material, but not so viscous that the pourability and dispensability of the detergent product is adversely affected.

Given the foregoing, there is clearly a continuing need to identify and provide liquid, particulate-containing detergent compositions in the form of nonaqueous liquid products that have a high degree of chemical, e.g., bleach and enzyme, stability along with commercially acceptable phase stability, pourability and detergent composition laundering, cleaning or bleaching performance. Accordingly, it is an object of the present invention to provide nonaqueous, particulate-containing liquid detergent products which have such especially desirable chemical and physical stability characteristics as well as outstanding pourability and fabric laundering/bleaching performance characteristics.

SUMMARY OF THE INVENTION

The present invention provides nonaqueous liquid detergent compositions comprising a stable suspension of solid, substantially insoluble particulate material dispersed throughout a structured, surfactant-containing liquid phase. Such compositions comprise A) from about 45% to 95% by weight of the composition of a surfactant-containing liquid phase which is structured by the insoluble fraction of an anionic surfactant-containing powder; and B) from about 5% to 55% by weight of the composition of additional insoluble particulate material.

The structured, surfactant-containing liquid phase is formed by combining a) one or more non-aqueous organic diluents (comprising from about 50% to 99% by weight of the liquid phase) with b) anionic surfactant-containing powder (comprising from about 1% to 50% by weight of the liquid phase). The anionic surfactant-containing powder is itself formed by co-drying one or more alkali metal salts of $C_{10-16}$ linear alkyl benzene sulfonic acids and one or more non-surfactant salts such as sodium sulfate or sodium citrate. Such co-drying produces a powder which contains from about 45% to 94% by weight of the alkyl benzene sulfonic acid salts, from about 2% to 50% by weight of the non-surfactant salts and from about 0.5% to 4% by weight of residual water. This anionic surfactant-containing powder also contains from about 10% to 60% by weight of a fraction which is insoluble in the non-aqueous organic diluents that are used to form the structured, surfactant-containing liquid phase of the compositions herein.

The additional insoluble particulate material which is suspended in the structured, surfactant-containing liquid phase to form the detergent compositions herein ranges in size from about 0.1 to 1500 microns. This particulate material is selected from peroxygen bleaching agents, bleach activators, ancillary anionic surfactants, organic detergent builders and inorganic alkalinity sources and combinations of these particulate material types.

DETAILED DESCRIPTION OF THE INVENTION

The non-aqueous liquid detergent compositions of this invention comprise a structured, surfactant-containing liquid phase in which solid substantially insoluble particulate material is suspended. The essential and optional components of the structured liquid phase and the solid dispersed materials of the detergent compositions herein, as well as composition form, preparation and use, are described in greater detail as follows: (All concentrations and ratios are on a weight basis unless otherwise specified.)

Surfactant-Structured Liquid Phase

The surfactant-containing, structured liquid phase will generally comprise from about 45% to 95% by weight of the detergent compositions herein. More preferably, this liquid phase will comprise from about 50% to 95% by weight of the compositions. Most preferably, this liquid phase will comprise from about 50% to 70% by weight of the compositions herein. The structured liquid phase of the detergent compositions herein is essentially formed from one or more non-aqueous organic diluents into which is mixed a specific type of anionic surfactant-containing powder.

(A) Non-aqueous Organic Diluents

The major component of the structured liquid phase of the detergent compositions herein comprises one or more non-aqueous organic diluents. The non-aqueous organic diluents used in this invention may be either surface active, i.e., surfactant, liquids or non-aqueous, non-surfactant liquids referred to herein as non-aqueous solvents. The term "solvent" is used herein to connote the non-surfactant, non-aqueous liquid portion of the compositions herein. While some of the essential and/or optional components of the compositions herein may actually dissolve in the "solvent"-containing liquid phase, other components will be present as particulate material dispersed within the "solvent"-containing liquid phase. Thus the term "solvent" is not meant to require that the solvent material be capable of actually dissolving all of the detergent composition components added thereto.

The non-aqueous liquid diluent component will generally comprise from about 50% to 99%, more preferably from about 50% to 80%, most preferably from about 55% to 75%, of the structured, surfactant-containing liquid phase. Preferably the liquid phase of the compositions herein, i.e., the non-aqueous liquid diluent component, will comprise both non-aqueous liquid surfactants and non-surfactant non-aqueous solvents.

i) Non-aqueous Surfactant Liquids

Suitable types of non-aqueous surfactant liquids which can be used to form the structured liquid phase of the compositions herein include the alkoxylated alcohols, ethylene oxide (EO)-propylene oxide (PO) block polymers, polyhydroxy fatty acid amides, alkylpolysaccharides, and the like. Such normally liquid surfactants are those having an HLB ranging from 10 to 16. Most preferred of the surfactant liquids are the alcohol alkoxylate nonionic surfactants.

Alcohol alkoxylates are materials which correspond to the general formula:

$$R^1(C_mH_{2m}O)_nOH$$

wherein $R^1$ is a $C_8$–$C_{16}$ alkyl group, m is from 2 to 4, and n ranges from about 2 to 12. Preferably $R^1$ is an alkyl group, which may be primary or secondary, that contains from about 9 to 15 carbon atoms, more preferably from about 10 to 14 carbon atoms. Preferably also the alkoxylated fatty alcohols will be ethoxylated materials that contain from about 2 to 12 ethylene oxide moieties per molecule, more preferably from about 3 to 10 ethylene oxide moieties per molecule.

The alkoxylated fatty alcohol materials useful in the liquid phase will frequently have a hydrophilic-lipophilic balance (HLB) which ranges from about 3 to 17. More preferably, the HLB of this material will range from about 6 to 15, most preferably from about 8 to 15.

Examples of fatty alcohol alkoxylates useful in or as the non-aqueous liquid phase of the compositions herein will include those which are made from alcohols of 12 to 15 carbon atoms and which contain about 7 moles of ethylene oxide. Such materials have been commercially marketed under the trade names Neodol 25-7 and Neodol 23-6.5 by Shell Chemical Company. Other useful Neodols include Neodol 1-5, an ethoxylated fatty alcohol averaging 11 carbon atoms in its alkyl chain with about 5 moles of ethylene oxide; Neodol 23-9, an ethoxylated primary $C_{12}$–$C_{13}$ alcohol having about 9 moles of ethylene oxide and Neodol 91-10, an ethoxylated $C_9$–$C_{11}$ primary alcohol having about 10 moles of ethylene oxide. Alcohol ethoxylates of this type have also been marketed by Shell Chemical Company under the Dobanol tradename. Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles of ethylene oxide per mole of fatty alcohol.

Other examples of suitable ethoxylated alcohols include Tergitol 15-S-7 and Tergitol 15-S-9 both of which are linear secondary alcohol ethoxylates that have been commercially marketed by Union Carbide Corporation. The former is a mixed ethoxylation product of $C_{11}$ to $C_{15}$ linear secondary alkanol with 7 moles of ethylene oxide and the latter is a similar product but with 9 moles of ethylene oxide being reacted.

Other types of alcohol ethoxylates useful in the present compositions are higher molecular weight nonionics, such as Neodol 45-11, which are similar ethylene oxide condensation products of higher fatty alcohols, with the higher fatty alcohol being of 14-15 carbon atoms and the number of ethylene oxide groups per mole being about 11. Such products have also been commercially marketed by Shell Chemical Company.

If alcohol alkoxylate nonionic surfactant is utilized as part of the non-aqueous liquid phase in the detergent compositions herein, it will preferably be present to the extent of from about 1% to 60% of the composition structured liquid phase. More preferably, the alcohol alkoxylate component will comprise about 5% to 40% of the structured liquid phase. Most preferably, an alcohol alkoxylate component will comprise from about 5% to 35% of the detergent composition structured liquid phase. Utilization of alcohol alkoxylate in these concentrations in the liquid phase corresponds to an alcohol alkoxylate concentration in the total composition of from about 1% to 60% by weight, more preferably from about 2% to 40% by weight, and most preferably from about 10% to 25% by weight, of the composition.

Another type of non-aqueous surfactant liquid which may be utilized in this invention are the ethylene oxide (EO)-propylene oxide (PO) block polymers. Materials of this type are well known nonionic surfactants which have been marketed under the tradename Pluronic. These materials are formed by adding blocks of ethylene oxide moieties to the ends of polypropylene glycol chains to adjust the surface active properties of the resulting block polymers. EO-PO block polymer nonionics of this type are described in greater detail in Davidsohn and Milwidsky; *Synthetic Detergents,* 7th Ed.; Longman Scientific and Technical (1987) at pp. 34–36 and pp. 189–191 and in U.S. Pat. Nos. 2,674,619 and 2,677,700. All of these publications are incorporated herein by reference. These Pluronic type nonionic surfactants are also believed to function as effective suspending agents for the particulate material which is dispersed in the liquid phase of the detergent compositions herein.

Another possible type of non-aqueous surfactant liquid useful in the compositions herein comprises polyhydroxy fatty acid amide surfactants. Materials of this type of non-ionic surfactant are those which conform to the formula:

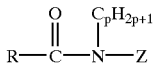

wherein R is a $C_{9-17}$ alkyl or alkenyl, p is from 1 to 6, and Z is glycityl derived from a reduced sugar or alkoxylated derivative thereof. Such materials include the $C_{12}$–$C_{18}$ N-methyl glucamides. Examples are N-methyl N-1-deoxyglucityl cocoamide and N-methyl N-1-deoxyglucityl oleamide. Processes for making polyhydroxy fatty acid, amides are know and can be found, for example, in Wilson, U.S. Pat. No. 2,965,576 and Schwartz, U.S. Pat. No. 2,703,798, the disclosures of which are incorporated herein by reference. The materials themselves and their preparation are also described in greater detail in Honsa, U.S. Pat. No. 5,174,937, Issued Dec. 26, 1992, which patent is also incorporated herein by reference.

The amount of total liquid surfactant in the surfactant-structured, non-aqueous liquid phase herein will be determined by the type and amounts of other composition components and by the desired composition properties. Generally, the liquid surfactant can comprise from about 35% to 70% of the non-aqueous structured liquid phase of the compositions herein. More preferably, the liquid surfactant will comprise from about 50% to 65% of the non-aqueous structured liquid phase. This corresponds to a non-aqueous liquid surfactant concentration in the total composition of from about 15% to 70% by weight, more preferably from about 20% to 50% by weight, of the composition.

ii) Non-surfactant Non-aqueous Organic Solvents

The structured liquid phase of the detergent compositions herein may also comprise one or more non-surfactant, non-aqueous organic solvents. Such non-surfactant non-aqueous liquids are preferably those of low polarity. For purposes of this invention, "low-polarity" liquids are those which have little, if any, tendency to dissolve one of the preferred types of particulate material used in the compositions herein, i.e., the peroxygen bleaching agents, sodium perborate or sodium percarbonate. Thus relatively polar solvents such as ethanol are preferably not utilized. Suitable types of low-polarity solvents useful in the non-aqueous liquid detergent compositions herein do include non-vicinal $C_4$–$C_8$ alkylene glycols, alkylene glycol mono lower alkyl ethers, lower molecular weight polyethylene glycols, lower molecular weight methyl esters and amides, and the like.

A preferred type of non-aqueous, low-polarity solvent for use in the compositions herein comprises the non-vicinal $C_4$–$C_8$ branched or straight chain alkylene glycols. Materials of this type include hexylene glycol (4-methyl-2,4-pentanediol), 1,6-hexanediol, 1,3-butylene glycol and 1,4-butylene glycol. Hexylene glycol is the most preferred.

Another preferred type of non-aqueous, low-polarity solvent for use herein comprises the mono-, di-, tri-, or tetra-$C_2$–$C_3$ alkylene glycol mono $C_2$–$C_6$ alkyl ethers. The specific examples of such compounds include diethylene glycol monobutyl ether, tetraethylene glycol monobutyl ether, dipropolyene glycol monoethyl ether, and dipropylene glycol monobutyl ether. Diethylene glycol monobutyl ether, dipropylene glycol monobutyl ether and butoxy-propoxy-propanol (BPP) are especially preferred. Compounds of the type have been commercially marketed under the tradenames Dowanol, Carbitol, and Cellosolve.

Another preferred type of non-aqueous, low-polarity organic solvent useful herein comprises the lower molecular weight polyethylene glycols (PEGs). Such materials are those having molecular weights of at least about 150. PEGs of molecular weight ranging from about 200 to 600 are most preferred.

Yet another preferred type of non-polar, non-aqueous solvent comprises lower molecular weight methyl esters. Such materials are those of the general formula: $R^1$—C(O)—$OCH_3$ wherein $R^1$ ranges from 1 to about 18. Examples of suitable lower molecular weight methyl esters include methyl acetate, methyl propionate, methyl octanoate, and methyl dodecanoate.

The non-aqueous, generally low-polarity, non-surfactant organic solvent(s) employed should, of course, be compatible and non-reactive with other composition components, e.g., bleach and/or activators, used in the liquid detergent compositions herein. Such a solvent component is preferably utilized in an amount of from about 1% to 70% by weight of the structured liquid phase. More preferably, a non-aqueous, low-polarity, non-surfactant solvent will comprise from about 10% to 60% by weight of the structured liquid phase, most preferably from about 20% to 50% by weight, of the structured liquid phase of the composition. Utilization of non-surfactant solvent in these concentrations in the structured liquid phase corresponds to a non-surfactant solvent concentration in the total composition of from about 1% to 50% by weight, more preferably from about 5% to 40% by weight, and most preferably from about 10% to 30% by weight, of the composition.

iii) Blends of Surfactant and Non-surfactant Solvents

In systems which employ both non-aqueous surfactant liquids and non-aqueous non-surfactant solvents, the ratio of surfactant to non-surfactant liquids, e.g., the ratio of alcohol alkoxylate to low polarity solvent, within the structured, surfactant-containing liquid phase can be used to vary the rheological properties of the detergent compositions eventually formed. Generally, the weight ratio of surfactant liquid to non-surfactant organic solvent will range about 50:1 to 1:50. More preferably, this ratio will range from about 3:1 to 1:3, most preferably from about 2:1 to 1:2.

(B) Anionic-Surfactant-Containing Powder

The surfactant-structured non-aqueous liquid phase of the detergent compositions of this invention is prepared by combining with the non-aqueous organic liquid diluents hereinbefore described a specific type of anionic surfactant-containing powder. Such a powder comprises two distinct phases. One of these phases is insoluble in the non-aqueous organic liquid diluents; the other phase is soluble in the non-aqueous organic liquids. It is the insoluble phase of this anionic surfactant-containing powder which is dispersed in the non-aqueous liquid phase of the compositions herein and forms a network of aggregated small particles that allows the final product to stably suspend other additional solid particulate materials in the composition.

The anionic surfactant-containing powder is formed by co-drying an aqueous slurry which essentially contains a) one of more alkali metal salts of $C_{10-16}$ linear alkyl benzene sulfonic acids; and b) one or more non-surfactant diluent salts. Such a slurry is dried to a solid material, generally in powder form, which comprises both the soluble and insoluble phases.

The linear alkyl benzene sulfonate (LAS) materials used to form the anionic surfactant-containing powder are well known materials. Such surfactants and their preparation are described for example in U.S. Pat. Nos. 2,220,099 and 2,477,383, incorporated herein by reference. Especially preferred are the sodium and potassium linear straight chain alkylbenzene sulfonates in which the average number of carbon atoms in the alkyl group is from about 11 to 14. Sodium $C_{11}$–$C_{14,}$ e.g., $C_{12}$, LAS is especially preferred. The alkyl benzene surfactant anionic surfactants are generally used in the powder-forming slurry in an amount from about 20 to 70% by weight of the slurry, more preferably from about 30% to 60% by weight of the slurry.

The powder-forming slurry also essentially contains a non-surfactant, organic or inorganic salt component that is co-dried with the LAS to form the two-phase anionic surfactant-containing powder. Such salts can be any of the known sodium, potassium or magnesium halides, sulfates, citrates, carbonates, sulfates, borates, succinates, sulfosuccinates xylene sulfonates, and the like. Sodium sulfate, which is generally a bi-product of LAS production, is the preferred non-surfactant diluent salt for use herein. Salts which function as hydrotropes such as sodium sulfosuccinate may also usefully be included. The non-surfactant salts are generally used in the aqueous slurry, along with the LAS, in amounts ranging from about 1% to 12% by weight of the slurry, more preferably from about 2% to 10% by weight of the slurry. Salts that act as hydrotropes can preferably comprise up to about 3% by weight of the slurry.

The aqueous slurry containing the LAS and diluent salt components hereinbefore described can be dried to form the anionic surfactant-containing powder used to prepare the structured liquid phase of the compositions herein. Any conventional drying technique, e.g., spray drying, drum drying, etc., or combination of drying techniques, may be employed. Drying should take place until the residual water content of the solid material which forms is within the range of from about 0.5% to 4% by weight, more preferably from about 1% to 3% by weight.

The anionic surfactant-containing powder produced by the drying operation iconstitutes two distinct phases, one of which is soluble in the inorganic liquid diluents used herein and one of which is insoluble in the diluents. The insoluble phase in the anionic surfactant-containing powder generally comprises from about 10% to 60%, more preferably from about 10% to 25% by weight of the powder. Most preferably, this insoluble phase comprises from about 15% to 25% by weight of a powder.

The anionic surfactant-containing powder that results after drying comprises from about 45% to 90%, more preferably from about 80% to 94%, by weight of the powder of alkylbenzene sulfonic acid salts. Such concentrations are generally sufficient to provide from about 0.5% to 60%, more preferably from about 15% to 60%, by weight of the total detergent composition of the alkyl benzene sulfonic acid salts. The anionic surfactant-containing powder itself can comprise from about 0.45% to 45% by weight of the total composition. After drying, the anionic surfactant-containing powder will also contain from about 2% to 50%, more preferably from about 2% to 15% by weight of the powder of the non-surfactant salts.

After it is dried to the requisite extent, the combined LAS/salt material is converted to flakes or powder form by any known suitable milling or comminution process. Generally at the time such material is combined with the non-aqueous organic solvents to form the structured liquid phase of the compositions herein, the particle size of this powder will range from 0.1 to 2000 microns, more preferably from about 0.1 to 1500 microns.

The structured, surfactant-containing liquid phase of the detergent compositions is prepared by combining the non-aqueous organic diluents hereinbefore described with the anionic surfactant-containing powder as hereinbefore described. Such combination results in the formation of the structured surfactant-containing liquid phase. Conditions for making this combination of structured liquid phase components are described more fully hereinafter in the "Composition Preparation and Use" section. As previously noted, the formation of the structured, surfactant-containing liquid phase permits the stable suspension of additional functional solid materials within the detergent compositions of this invention.

Additional Solid Particulate Materials

In addition to the insoluble phase of the anionic surfactant-containing powder which is dispersed throughout the structured liquid phase, the non-aqueous detergent compositions herein also essentially comprise from about 5% to 55% by weight, more preferably from about 10% to 50% by weight, of additional solid phase particulate material which is dispersed and suspended within the liquid phase. Generally such particulate material will range in size from about 0.1 to 1500 microns, more preferably from about 0.1 to 900 microns. Most preferably such material will range in size from about 5 to 200 microns.

The additional particulate material utilized herein can comprise one or more types of detergent composition components which in particulate form are substantially insoluble in the non-aqueous liquid phase of the composition. The types of particulate materials which can be utilized are described in detail as follows:

(A) Peroxygen Bleaching Agent with Optional Bleach Activators

The most preferred type of particulate material useful in the detergent compositions herein comprises particles of a peroxygen bleaching agent. Such peroxygen bleaching agents may be organic or inorganic in nature. Inorganic peroxygen bleaching agents are frequently utilized in combination with a bleach activator.

Useful organic peroxygen bleaching agents include percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, Issued Nov. 20, 1984; European Patent Application EP-A-133,354, Banks et al., Published Feb. 20, 1985; and U.S. Pat. No. 4,412,934, Chung et al., Issued Nov. 1, 1983. Highly preferred bleaching agents also include 6-nonylamino-6-oxoperoxycaproic acid (NAPAA) as described in U.S. Pat. No. 4,634,551, Issued Jan. 6, 1987 to Bums et al.

Inorganic peroxygen bleaching agents may also be used in particulate form in the detergent compositions herein. Inorganic bleaching agents are in fact preferred. Such inorganic peroxygen compounds include alkali metal perborate and percarbonate materials, most preferably the percarbonates. For example, sodium perborate (e.g. mono- or tetra-hydrate) can be used. Suitable inorganic bleaching agents can also include sodium or potassium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used. Frequently inorganic peroxygen bleaches will be coated with silicate, borate, sulfate or water-soluble surfactants. For example, coated percarbonate particles are available from various commercial sources such as FMC, Solvay Interox, Tokai Denka and Degussa.

Inorganic peroxygen bleaching agents, e.g., the perborates, the percarbonates, etc., are preferably combined with bleach activators, which lead to the in situ production in aqueous solution (i.e., during use of the compositions herein for fabric laundering/bleaching) of the peroxy acid corresponding to the bleach activator. Various non-limiting examples of activators are disclosed in U.S. Pat. No. 4,915,854, Issued Apr. 10, 1990 to Mao et al.; and U.S. Pat. No. 4,412,934 Issued Nov. 1, 1983 to Chung et al. The nonanoyloxybenzene sulfonate (NOBS) and tetraacetyl ethylene diamine (TAED) activators are typical. Mixtures thereof can also be used. See also the hereinbefore referenced U.S. Pat. No. 4,634,551 for other typical bleaches and activators useful herein.

Other useful amido-derived bleach activators are those of the formulae:

$$R^1N(R^5)C(O)R^2C(O)L$$

or $$R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenol sulfonate.

Preferred examples of bleach activators of the above formulae include (6-octanamido-caproyl) oxybenzenesulfonate, (6-nonanamidocaproyl) oxybenzenesulfonate, (6-decanamido-caproyl) oxybenzenesulfonate and mixtures thereof as described in the hereinbefore referenced U.S. Pat. No. 4,634,551. Such mixtures are characterized herein as (6-$C_8$–$C_{10}$ alkamido-caproyl)oxybenzenesulfonate.

Another class of useful bleach activators comprises the benzoxazin-type activators disclosed by Hodge et al. in U.S. Pat. No. 4,966,723, Issued Oct. 30, 1990, incorporated herein by reference. A highly preferred activator of the benzoxazin-type is:

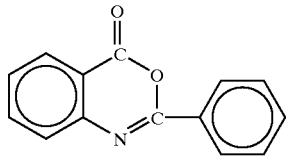

Still another class of useful bleach activators includes the acyl lactam activators, especially acyl caprolactams and acyl valerolactams of the formulae:

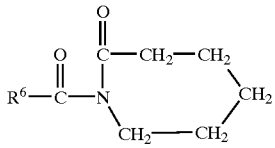

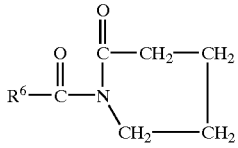

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, 3,5,5-trimethylhexanoyl valerolactam and mixtures thereof. See also U.S. Pat. No. 4,545,784, Issued to Sanderson, Oct. 8, 1985, incorporated herein by reference, which discloses acyl caprolactams, including benzoyl caprolactam, adsorbed into sodium perborate.

If peroxygen bleaching agents are used as all or part of the essentially present additional particulate material, they will generally comprise from about 1% to 30% by weight of the composition. More preferably, peroxygen bleaching agent will comprise from about 1% to 20% by weight of the composition. Most preferably, peroxygen bleaching agent will be present to the extent of from about 3% to 15% by weight of the composition. If utilized, bleach activators can comprise from about 0.5% to 20%, more preferably from about 1% to 10%, by weight of the composition. Frequently, activators are employed such that the molar ratio of bleaching agent to activator ranges from about 1:1 to 10:1, more preferably from about 1.5:1 to 5:1. In addition, it has been found that bleach activators, when agglomerated with certain acids such as citric acid, are more chemically stable.

(B) Ancillary Anionic Surfactants

Another possible type of additional particulate material which can be suspended in the non-aqueous liquid detergent compositions herein includes ancillary anionic surfactants which are fully or partially insoluble in the non-aqueous liquid phase. The most common type of anionic surfactant with such solubility properties comprises primary or secondary alkyl sulfate anionic surfactants. Such surfactants are those produced by the sulfation of higher $C_8$–$C_{20}$ fatty alcohols.

Conventional primary alkyl sulfate surfactants have the general formula $$ROSO_3^-M^+$$

wherein R is typically a linear $C_8$–$C_{20}$ hydrocarbyl group, which may be straight chain or branched chain, and M is a water-solubilizing cation. Preferably R is a $C_{10}$–$C_{14}$ alkyl, and M is alkali metal. Most preferably R is about $C_{12}$ and M is sodium.

Conventional secondary alkyl sulfates may also be utilized as the essential anionic surfactant component of the solid phase of the compositions herein. Conventional secondary alkyl sulfate surfactants are those materials which have the sulfate moiety distributed randomly along the hydrocarbyl "backbone" of the molecule. Such materials may be depicted by the structure:

$$CH_3(CH_2)_n(CHOSO3\text{–}M^+)\ (CH_2)_mCH_3$$

wherein m and n are integers of 2 or greater and the sum of m+n is typically about 9 to 15, and M is a water-solubilizing cation.

If utilized as all or part of the additional particulate material, ancillary anionic surfactants such as alkyl sulfates will generally comprise from about 1% to 10% by weight of the composition, more preferably from about 1% to 5% by weight of the composition.

(C) Organic Builder Material

Another possible type of additional particulate material which can be suspended in the non-aqueous liquid detergent compositions herein comprises an organic detergent builder material which serves to counteract the effects of calcium, or other ion, water hardness encountered during laundering/bleaching use of the compositions herein. Examples of such materials include the alkali metal, citrates, succinates, malonates, fatty acids, carboxymethyl succinates, carboxylates, polycarboxylates and polyacetyl carboxylates. Specific examples include sodium, potassium and lithium salts of oxydisuccinic acid, mellitic acid, benzene polycarboxylic acids and citric acid. Other examples of organic phosphonate type sequestering agents such as those which have been sold by Monsanto under the Dequest tradename and alkanehydroxy phosphonates. Citrate salts are highly preferred.

Other suitable organic builders include the higher molecular weight polymers and copolymers known to have builder properties. For example, such materials include appropriate polyacrylic acid, polymaleic acid, and polyacrylic/polymaleic acid copolymers and their salts, such as those sold by BASF under the Sokalan trademark, which have a molecular weight ranging from about 5,000 to 100,000.

Another suitable type of organic builder comprises the water-soluble salts of higher fatty acids, i.e., "soaps". These include alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

If utilized as all or part of the additional particulate material, insoluble organic detergent builders can generally comprise from about 2% to 20% by weight of the compositions herein. More preferably, such builder material can comprise from about 4% to 10% by weight of the composition.

(D) Inorganic Alkalinity Sources

Another possible type of additional particulate material which can be suspended in the non-aqueous liquid detergent compositions herein can comprise a material which serves to render aqueous washing solutions formed from such compositions generally alkaline in nature. Such materials may or may not also act as detergent builders, i.e., as materials which counteract the adverse effect of water hardness on detergency performance.

Examples of suitable alkalinity sources include water-soluble alkali metal carbonates, bicarbonates, borates, silicates and metasilicates. Although not preferred for ecological reasons, water-soluble phosphate salts may also be utilized as alkalinity sources. These include alkali metal pyrophosphates, orthophosphates, polyphosphates and phosphonates. Of all of these alkalinity sources, alkali metal carbonates such as sodium carbonate are the most preferred.

The alkalinity source, if in the form of a hydratable salt, may also serve as a desiccant in the non-aqueous liquid detergent compositions herein. The presence of an alkalinity source which is also a desiccant may provide benefits in terms of chemically stabilizing those composition components such as the peroxygen bleaching agent which may be susceptible to deactivation by water.

If utilized as all or part of the additional particulate material component, the alkalinity source will generally comprise from about 1% to 25% by weight of the compositions herein. More preferably, the alkalinity source can comprise from about 5% to 15% by weight of the composition. Such materials, while water-soluble, will generally be insoluble in the non-aqueous detergent compositions herein. Thus such materials will generally be dispersed in the non-aqueous liquid phase in the form of discrete particles.

Optional Composition Components

In addition to the essential composition liquid and solid phase components as hereinbefore described, the detergent compositions herein can, and preferably will, contain various optional components. Such optional components may be in either liquid or solid form. The optional components may either dissolve in the liquid phase or may be dispersed within the liquid phase in the form of fine particles or droplets. Some of the materials which may optionally be utilized in the compositions herein are described in greater detail as follows:

(a) Optional Surfactants

Besides the essentially utilized alkylbenzene sulfonate surfactant materials and the liquid surfactant component of the liquid phase, the detergent compositions herein may, in addition to the optional alkyl sulfates hereinbefore described, also contain other types of surfactant materials. Such additional optional surfactants must, of course, be compatible with other composition components and must not substantially adversely affect composition rheology, stability or performance. Optional surfactants can be of the anionic, nonionic, cationic, and/or amphoteric type. If employed, optional surfactants will generally comprise from about 1% to 20% by weight of the compositions herein, more preferably from about 5% to 10% by weight of the compositions herein.

One common type of anionic surfactant material which may be optionally added to the detergent compositions herein comprises the alkyl polyalkoxylate sulfates. Alkyl polyalkoxylate sulfates are also known as alkoxylated alkyl sulfates or alkyl ether sulfates. Such materials are those which correspond to the formula $$R^2\text{—}O\text{—}(C_mH_{2m}O)_n\text{—}SO_3M$$

wherein $R^2$ is a $C_{10}$–$C_{22}$ alkyl group, m is from 2 to 4, n is from about 1 to 15, and M is a salt-forming cation. Preferably, $R^2$ is a $C_{12}$–$C_{18}$ alkyl, m is 2, n is from about 1 to 10, and M is sodium, potassium, ammonium, alkylammonium or alkanolammonium. Most preferably, $R^2$ is a $C_{12}$–$C_{16}$, m is 2, n is from about 1 to 6, and M is sodium.

Ammonium, alkylammonium and alkanolammonium counterions are preferably avoided when the solid phase materials used in the compositions herein include a peroxygen bleaching agent.

Another common type of anionic surfactant material which may be optionally added to the detergent compositions herein comprises carboxylate-type anionics. Carboxylate-type anionics include the $C_{10}$–$C_{18}$ alkyl alkoxy carboxylates (especially the EO 1 to 5 ethoxycarboxylates) and the $C_{10}$–$C_{18}$ sarcosinates, especially oleoyl sarcosinate. Another common type of anionic surfactant material which may be optionally employed comprises other sulfonated anionic surfactants such as the $C_8$–$C_{18}$ paraffin sulfonates and the $C_8$–$C_{18}$ olefin sulfonates.

(b) Optional Inorganic Detergent Builders

The detergent compositions herein may also optionally contain one or more types of inorganic detergent builders beyond those listed hereinbefore that also function as alkalinity sources. Such optional inorganic builders can include, for example, aluminosilicates such as zeolites. Aluminosilicate zeolites, and their use as detergent builders are more fully discussed in Corkill et al., U.S. Pat. No. 4,605,509; Issued Aug. 12, 1986, the disclosure of which is incorporated herein by reference. Also crystalline layered silicates, such as those discussed in this '509 U.S. patent, are also suitable for use in the detergent compositions herein. If utilized, optional inorganic detergent builders can comprise from about 2% to 15% by weight of the compositions herein.

(c) Optional Enzymes

The detergent compositions herein may also optionally contain one or more types of detergent enzymes. Such enzymes can include proteases, amylases, cellulases and lipases. Such materials are known in the art and are commercially available. They may be incorporated into the non-aqueous liquid detergent compositions herein in the form of suspensions, "marumes" or "prills". Another suitable type of enzyme comprises those in the form of slurries of enzymes in nonionic surfactants, e.g., the enzymes marketed by Novo Nordisk under the tradename "SL" or the microencapsulated enzymes marketed by Novo Nordisk under the tradename "LDP."

Enzymes added to the compositions herein in the form of conventional enzyme prills are especially preferred for use herein. Such prills will generally range in size from about 100 to 1,000 microns, more preferably from about 200 to 800 microns and will be suspended throughout the non-aqueous liquid phase of the composition. Prills in the compositions of the present invention have been found, in comparison with other enzyme forms, to exhibit especially desirable enzyme stability in terms of retention of enzymatic activity over time. Thus, compositions which utilize enzyme prills need not contain conventional enzyme stabilizing such as must frequently be used when enzymes are incorporated into aqueous liquid detergents.

If employed, enzymes will normally be incorporated into the non-aqueous liquid compositions herein at levels sufficient to provide up to about 10 mg by weight, more typically from about 0.01 mg to about 5 mg, of active enzyme per gram of the composition. Stated otherwise, the non-aqueous liquid detergent compositions herein will typically comprise from about 0.001% to 5%, preferably from about 0.01% to 1% by weight, of a commercial enzyme preparation. Protease enzymes, for example, are usually present in such commercial preparations at levels sufficient to provide from 0.005 to 0.1 Anson units (AU) of activity per gram of composition.

(d) Optional Chelating Agents

The detergent compositions herein may also optionally contain a chelating agent which serves to chelate metal ions, e.g., iron and/or manganese, within the non-aqueous detergent compositions herein. Such chelating agents thus serve to form complexes with metal impurities in the composition which would otherwise tend to deactivate composition components such as the peroxygen bleaching agent. Useful chelating agents can include amino carboxylates, phosphonates, amino phosphonates, polyfunctionally-substituted aromatic chelating agents and mixtures thereof.

Amino carboxylates useful as optional chelating agents include ethylenediaminetetraacetates, N-hydroxyethylethylenediaminetriacetates, nitrilotriacetates, ethylenediamine tetrapropionates, triethylenetetraaminehexacetates, diethylenetriaminepentaacetates, ethylenediaminedisuccinates and ethanoldiglycines. The alkali metal salts of these materials are preferred.

Amino phosphonates are also suitable for use as chelating agents in the compositions of this invention when at least low levels of total phosphorus are permitted in detergent compositions, and include ethylenediaminetetrakis (methylene-phosphonates) as DEQUEST. Preferably, these amino phosphonates do not contain alkyl or alkenyl groups with more than about 6 carbon atoms.

Preferred chelating agents include hydroxyethyldiphosphonic acid (HEDP), diethylene triamine penta acetic acid (DTPA), ethylenediamine disuccinic acid (EDDS) and dipicolinic acid (DPA) and salts thereof. The chelating agent may, of course, also act as a detergent builder during use of the compositions herein for fabric laundering/bleaching. The chelating agent, if employed, can comprise from about 0.1% to 4% by weight of the compositions herein. More preferably, the chelating agent will comprise from about 0.2% to 2% by weight of the detergent compositions herein.

(e) Optional Thickening, Viscosity Control and/or Dispersing Agents

The detergent compositions herein may also optionally contain a polymeric material which serves to enhance the ability of the composition to maintain its solid particulate components in suspension. Such materials may thus act as thickeners, viscosity control agents and/or dispersing agents. Such materials are frequently polymeric polycarboxylates but can include other polymeric materials such as polyvinylpyrrolidone (PVP) or polyamide resins. Insoluble materials like fumed silica and titanium dioxide may also be used to enhance the elasticity of the surfactant-structured liquid phase.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight of the polymer.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 100,000, more preferably from about 2,000 to 10,000, even more preferably from about 4,000 to 7,000, and most preferably from about 4,000 to 5,000. Water-soluble salts of such acrylic acid polymers can include, for example, the alkali metal, salts. Soluble polymers of this type are known materials. Use of polyacrylates of this type in detergent compositions has been disclosed, for example, Diehl, U.S. Pat. No. 3,308,067, issued Mar. 7, 1967. Such materials may also perform a builder function.

If utilized, the optional thickening, viscosity control and/or dispersing agents should be present in the compositions herein to the extent of from about 0.1% to 4% by weight. More preferably, such materials can comprise from about 0.5% to 2% by weight of the detergents compositions herein.

(f) Optional Clay Soil Removal/Anti-redeposition Agents

The compositions of the present invention can also optionally contain water-soluble ethoxylated amines having clay soil removal and anti-redeposition properties. If used, soil materials can contain from about 0.01% to about 5% by weight of the compositions herein.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal-anti-redeposition agents are the cationic compounds disclosed in European Patent Application 111,965, Oh and Gosselink, published Jun. 27, 1984. Other clay soil removal/anti-redeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti-redeposition agents known in the art can also be utilized in the compositions herein. Another type of preferred anti-redeposition agent includes the carboxy methyl cellulose (CMC) materials. These materials are well known in the art.

(g) Optional Liquid Bleach Activators

The detergent compositions herein may also optionally contain bleach activators which are liquid in form at room temperature and which can be added as liquids to the non-aqueous liquid phase of the detergent compositions herein. One such liquid bleach activator is acetyl triethyl citrate (ATC). Other examples include glycerol triacetate and nonanoyl valerolactam. Liquid bleach activators can be dissolved in the non-aqueous liquid phase of the compositions herein.

(h) Optional Brighteners Suds Suppressors, Dyes and/or Perfumes

The detergent compositions herein may also optionally contain conventional brighteners, suds suppressors, bleach catalysts, dyes and/or perfume materials. Such brighteners, suds suppressors, silicone oils, bleach catalysts, dyes and perfumes must, of course, be compatible and non-reactive with the other composition components in a non-aqueous environment. If present, brighteners suds suppressors, dyes and/or perfumes will typically comprise from about 0.0001% to 2% by weight of the compositions herein. Suitable bleach catalysts include the manganese based complexes disclosed in U.S. Pat. Nos. 5,246,621, 5,244,594, 5,114,606 and 5,114,611.

Composition Form

As indicated, the non-aqueous liquid detergent compositions herein are in the form of bleaching agent and/or other materials in particulate form as a solid phase suspended in and dispersed throughout a surfactant-containing, structured non-aqueous liquid phase. Generally, the structured non-aqueous liquid phase will comprise from about 45% to 95%, more preferably from about 50% to 90%, by weight of the composition with the dispersed additional solid materials comprising from about 5% to 55%, more preferably from about 20% to 50%, by weight of the composition.

The particulate-containing liquid detergent compositions of this invention are substantially non-aqueous (or anhydrous) in character. While very small amounts of water may be incorporated into such compositions as an impurity in the essential or optional components, the amount of water should in no event exceed about 5% by weight of the compositions herein. More preferably, water content of the non-aqueous detergent compositions herein will comprise less than about 1% by weight.

The particulate-containing non-aqueous liquid detergent compositions herein will be relatively viscous and phase stable under conditions of commercial marketing and use of such compositions. Frequently the viscosity of the compositions herein will range from about 300 to 5,000 cps, more preferably from about 500 to 3,000 cps. For purposes of this invention, viscosity is measured with a Carrimed CSL2 Rheometer at a shear rate of 20 $s^{-1}$.

Composition Preparation and Use

The non-aqueous liquid detergent compositions herein can be prepared by first forming the structured, surfactant-containing non-aqueous liquid phase and by thereafter adding to this structured phase the additional particulate components in any convenient order and by mixing, e.g., agitating, the resulting component combination to form the phase stable compositions herein. In a typical process for preparing such compositions, essential and certain preferred optional components will be combined in a particular order and under certain conditions.

In a first step of a preferred preparation process, the anionic surfactant-containing powder used to form the structured, surfactant-containing liquid phase is prepared. This pre-preparation step involves the formation of an aqueous slurry containing from about 30% to 60% of one or more alkali metal salts of linear $C_{10-16}$ alkyl benzene sulfonic acid and from about 2% to 10% of one or more diluent non-surfactant salts. In a subsequent step, this slurry is dried to the extent necessary to form a solid material containing less than about 4% by weight of residual water.

After preparation of this solid anionic surfactant-containing material, this material can be combined with one or more of the non-aqueous organic diluents to form the structured, surfactant-containing liquid phase of the detergent compositions herein. This is done by reducing the anionic surfactant-containing material formed in the previously described pre-preparation step to powdered form and by combining such powdered material with an agitated liquid medium comprising one or more of the non-aqueous organic diluents, either surfactant or non-surfactant or both, as hereinbefore described. This combination is carried out under agitation conditions which are sufficient to form a thoroughly mixed dispersion of particles of the insoluble fraction of the co-dried LAS/salt material throughout a non-aqueous organic liquid diluent.

In a subsequent processing step, the non-aqueous liquid dispersion so prepared can then be subjected to milling or high shear agitation under conditions which are sufficient to provide the structured, surfactant-containing liquid phase of the detergent compositions herein. Such milling or high shear agitation conditions will generally include maintenance of a temperature between about 10° C. and 90° C., preferably between about 20° C. and 60° C.; and a processing time that is sufficient to form a network of aggregated small particles of the insoluble fraction of the anionic surfactant-containing powdered material. Suitable equipment for this purpose includes: stirred ball mills, co-ball mills (Fryma), colloid mills, high pressure homogenizers, high shear mixers, and the like. The colloid mill and high shear mixers are preferred for their high throughput and low capital and maintenance costs. The small particles produced in such equipment will generally range in size from about 0.4 to 2 microns. Milling and high shear agitation of the liquid/solids combination will generally provide an increase in the yield value of the structured liquid phase to within the range of from about 1 Pa to 8 Pa, preferably from about 1 Pa to 4 Pa.

After formation of the dispersion of LAS/salt co-dried material in the non-aqueous liquid, either before or after such dispersion is milled or agitated to increase its yield value, the additional particulate material to be used in the detergent compositions herein can be added. Such components which can be added under high shear agitation include any optional surfactant particles, particles of substantially all of an organic builder, e.g., citrate and/or fatty acid, and/or an alkalinity source, e.g., sodium carbonate, can be added while continuing to maintain this admixture of composition components under shear agitation. Agitation of the mixture is continued, and if necessary, can be increased at this point to form a uniform dispersion of insoluble solid phase particulates within the liquid phase.

After some or all of the foregoing solid materials have been added to this agitated mixture, the particles of the highly preferred peroxygen bleaching agent can be added to the composition, again while the mixture is maintained under shear agitation. By adding the peroxygen bleaching agent material last, or after all or most of the other components, and especially after alkalinity source particles, have been added, desirable stability benefits for the peroxygen bleach can be realized. If enzyme prills are incorporated, they are preferably added to the non-aqueous liquid matrix last.

As a final process step, after addition of all of the particulate material, agitation of the mixture is continued for a period of time sufficient to form compositions having the requisite viscosity, yield value and phase stability characteristics. Frequently this will involve agitation for a period of from about 1 to 30 minutes.

In adding solid components to non-aqueous liquids in accordance with the foregoing procedure, it is advantageous to maintain the free, unbound moisture content of these solid materials below certain limits. Free moisture in such solid materials is frequently present at levels of 0.8% or greater. By reducing free moisture content, e.g., by fluid bed drying, of solid particulate materials to a free moisture level of 0.5% or lower prior to their incorporation into the detergent composition matrix, significant stability advantages for the resulting composition can be realized.

The compositions of this invention, prepared as hereinbefore described, can be used to form aqueous washing solutions for use in the laundering and bleaching of fabrics. Generally, an effective amount of such compositions is added to water, preferably in a conventional fabric laundering automatic washing machine, to form such aqueous laundering/bleaching solutions. The aqueous washing/bleaching solution so formed is then contacted, preferably under agitation, with the fabrics to be laundered and bleached therewith.

An effective amount of the liquid detergent compositions herein added to water to form aqueous laundering/bleaching solutions can comprise amounts sufficient to form from about 500 to 7,000 ppm of composition in aqueous solution. More preferably, from about 800 to 3,000 ppm of the detergent compositions herein will be provided in aqueous washing/bleaching solution.

The following examples illustrate the preparation and performance advantages of non-aqueous liquid detergent compositions of the instant invention. Such examples, however, are not necessaruly meant to limit or otherwise define the scope of the invention herein.

EXAMPLE I

Preparation of LAS Powder

Sodium $C_{12}$ linear alkyl benzene sulfonate (NaLAS) is processed into a powder containing two phases. One of these phases is soluble in the non-aqueous liquid detergent compositions herein and the other phase is insoluble. It is the insoluble fraction which serves to add structure and particle suspending capability to the non-aqueous phase of the compositions herein.

NaLAS powder is produced by taking a slurry of NaLAS in water (approximately 40–50% active) combined with dissolved sodium sulfate (3–15%) and a hydrotrope, sodium sulfosuccinate (1–3%). The hydrotrope and sulfate are used to improve the characteristics of the dry powder. A drum dryer is used to dry the slurry into a flake. When the NaLAS is dried with the sodium sulfate, two distinct phases are created within the flake. The insoluble phase creates a network structure of aggregate small particles (0.4–2 um) which allows the finished non-aqueous detergent product to stably suspend solids.

The NaLAS powder prepared according to this example has the following makeup shown in Table I.

TABLE I

LAS Powder

| Component | Wt. % |
|---|---|
| NaLAS | 85% |
| Sulfate | 11% |
| Sulfosuccinate | 2% |
| Water | 2.5% |
| Unreacted, etc | balance to 100% |
| % insoluble LAS | 17% |
| # of phase (via X-ray diffraction) | 2 |

EXAMPLE II

Preparation of Non-Aqueous Liquid Deterrent Composition

1) Butoxy-propoxy-propanol (BPP) and a $C_{11-15}$EO(5) ethoxylated alcohol nonionic surfactant (Neodol 1-5) are mixed for a short time (1–2 minutes) using a pitched blade turbine impeller in a mix tank into a single phase.
2) NaLAS powder as prepared in Example I is added to the BPP/Neodol solution in the mix tank to partially dissolve the NaLAS. Mix time is approximately one hour. The tank is blanketed with nitrogen to prevent moisture pickup from the air. The soluble phase of NaLAS powder dissolves, while the insoluble NaLAS aggregates and forms a network structure within the BPP/Neodol solution.
3) Liquid base (LAS/BPP/NI) is pumped out into drums. Molecular sieves (type 3A, 4–8 mesh) are added to each drum at 10% of the net weight of the liquid base. The molecular sieves are mixed into the liquid base using both single blade turbine mixers and drum rolling techniques. The mixing is done under nitrogen blanket to prevent moisture pickup from the air. Total mix time is 2 hours, after which 0.1–0.4% of the moisture in the liquid base is removed.

4) Molecular sieves are removed by passing the liquid base through a 20–30 mesh screen. Liquid base is returned to the mix tank.

5) Additional solid ingredients are prepared for addition to the composition. Such solid ingredients include the following:

Sodium carbonate (particle size 10–40 microns)

Sodium citrate dihydrate

Maleic-acrylic copolymer (BASF's Sokalan CP5; moisture content 4.1–5.0%)

Brightener

Diethyl triamine pentaacetic acid (DTPA)

Titanium dioxide particles (1–5 microns)

These solid materials, which are all millable, are added to the mix tank through a 20–30 mesh screen and mixed with the liquid base until smooth. This approximately 1 hour after addition of the last powder. The tank is blanketed with nitrogen after addition of the powders. No particular order of addition for these powders is critical.

6) The batch is pumped once through a Fryma colloid mill, which is a simple rotor-stator configuration in which a high-speed rotor spins inside a stator which creates a zone of high shear. This serves to disperse the insoluble NaLAS aggregates and partially reduce the particle size of all of the solids. This leads to an increase in yield value (i.e. structure). The batch is then recharged to the mix tank.

7) Still additional solid materials which should not be milled or subjected to high shear agitation are then prepared. These include the following/

Sodium nonanoyloxybenzene sulfonate (NOBS) coated with

Sodium citrate dihydrate

NOBS 60%

Citrate 40%

Sodium perborate (20–40 microns)

Protease and amylase enzyme prills (100–1000 microns)

These non-millable solid materials are then added to the mix tank followed by liquid ingredients (perfume and silicone-based suds suppressor). The batch is then mixed for one hour (under nitrogen blanket). The resulting composition has the formula set forth in Table II.

TABLE II

Non-Aqueous Liquid Detergent Composition with Bleach

| Component | Wt % Active |
|---|---|
| LAS Powder | 20.26 |
| $C_{12-14}$EO = 5 alcohol ethoxylate | 18.82 |
| BPP | 18.82 |
| Sodium citrate dihydrate | 4.32 |
| Citrate Coated NOBS | 8.49 |
| Sodium Carbonate | 11.58 |
| Maleic-acrylic copolymer | 11.58 |
| DTPA | 0.77 |
| Protease Prills | 0.77 |
| Amylase Prills | 0.39 |
| Sodium Perborate | 2.86 |
| Suds Suppressor | 0.03 |

TABLE II-continued

Non-Aqueous Liquid Detergent Composition with Bleach

| Component | Wt % Active |
|---|---|
| Perfume | 0.46 |
| Titanium Dioxide | 0.54 |
| Brightener | 0.31 |
| | 100.00% |

The resulting Table II composition is a stable, anhydrous heavy-duty liquid laundry detergent which provides excellent stain and soil removal performance when used in normal fabric laundering operations.

EXAMPLE III

Effect of Sulfate Level in NaLAS Powder on Structured, Non-Aqueous Base Rheology Several LAS-containing, structured non-aqueous liquid base samples are prepared in accordance with the general procedure of Steps 1 and 2 of Example II. Each sample uses an NaLAS powder which is prepared using a different amount of sodium sulfate as the non-surfactant salt diluent in the powder. All powder samples are dried to a residual water content of 1–3%.

The structured liquid bases so prepared are evaluated for their rheological properties. Results are shown in Table III.

TABLE III

Rheology of Non-aqueous Liquid Detergent Bases

| | Base No. | | | |
|---|---|---|---|---|
| Component (Wt. %) | A | B | C | D |
| NaLAS Powder | 40% | 40% | 40% | 40% |
| Sulfate Content | 1% | 2.5% | 5.2% | 8.0% |
| Neodol 1-5 | 35% | 35% | 35% | 35% |
| Butoxy Propoxy-Propanol | 25% | 25% | 25% | 25% |
| Rheology | | | | |
| Yield Value | 0 Pa | 0.5 Pa | 1 Pa | 25 Pa |
| Pouring Viscosity | 300 cps | 600 cps | 1000 cps | 1500 cps |

The Table III data indicate that co-drying of LAS with increasing amounts of sulfate diluent salt provides non-aqueous structured liquid bases of increasing capability of suspending solids as shown by their rheological characteristics.

What is claimed is:

1. A non-aqueous, liquid, heavy-duty detergent in the form of a suspension of solid, substantially insoluble particulate material dispersed throughout a structured, surfactant-containing liquid phase, wherein:

A) said composition comprises from about 45% to 95% by weight of the composition of a structured, surfactant-containing liquid phase formed by combining:

i) from about 50% to 80% by weight of said liquid phase of one or more non-aqueous organic diluents; and ii) from about 20% to 50% by weight of said liquid phase of an anionic surfactant-containing powder which is formed by co-drying:

a) one or more alkali metal salts of $C_{10-16}$ linear alkyl benzene sulfonic acids; and b) a non-surfactant salt selected from the group consisting of alkali metal salts of sulfates citrates, sulfo-succinates and mixtures thereof;

to produce a powder which contains from about 80% to 94% by weight of said powder of said alkyl benzene sulfonic acid salts, from about 2% to 15% by weight of said powder of said non-surfactant salts and from about 0.5% to 4% by weight of said powder of residual water; and which contains from about 10% to 25% by weight of said powder of a solid phase which is insoluble in said non-aqueous organic diluents; and B) said composition also comprises from about 5% to 55% by weight of the composition of additional particulate material which ranges in size from about 0.1 to 1500 microns, which is substantially insoluble in said liquid phase and which is selected from peroxygen bleaching agents, bleach activators, ancillary anionic surfactants, organic detergent builders and inorganic alkalinity sources and combinations of said particulate material types.

2. A composition according to claim 1 wherein (A) the alkyl group of said alkylbenzene sulfonic acid is linear and contains from about 11 to 14 carbon atoms;

(B) the non-surfactant salts are selected from akali metal sulfates, citrates, carbonates and xylene sulfonates;

(C) the liquid phase comprises both a non-aqueous liquid nonionic surfactant and a non-aqueous low polarity non-surfactant solvent; and (D) said particulate material comprises peroxygen bleaching agents selected from percarboxylic acids and salts thereof and alkali metal perborates and percarbonates.

3. A composition according to claim 2 wherein (A) said alkylbenzene sulfonate surfactant comprises from about 0.5% to 60% by weight of the composition;

(B) said nonaqueous liquid phase comprises from about 15% to 70% by weight of the composition and utilizes an alcohol alkoxylate liquid nonionic surfactant in a ratio to non-surfactant solvent of from 3:1 to 1:3; and (C) said particulate material comprises from about 5% to 50% by weight of the composition.

4. A composition according to claim 3 wherein (A) said peroxygen bleaching agent is selected from alkali metal perborates and percarbonates and comprises from about 1% to 30% by weight of the composition; and (B) said particulate material also comprises from about 0.5% to 20% by weight of the composition of particles of a bleach activator which can react with said peroxygen bleaching agent to form a peroxy acid.

5. A composition according to claim 4 wherein (A) said alcohol alkoxylate nonionic surfactant comprises ethoxylated materials containing from about 8 to 15 carbon atoms and having from about 3 to 10 ethylene oxide moieties per molecule; and (B) said nonaqueous low-polarity non-surfactant solvent is selected from i) mono, di, tri, tetra $C_2$–$C_3$ alkylene glycol mono $C_2$–$C_6$ alkyl ethers; and ii) non-vicinal alkylene glycols containing from about 4 to 8 carbon atoms.

6. A composition according to claim 4 wherein said particulate material also comprises from about 2% to 20% by weight of the composition of an organic detergent builder selected from alkali metal citrates, succinates, malonates, carboxymethylsuccinates, carboxylates, polycarboxylates, polyacetylcarboxylates and fatty acid soaps.

7. A composition according to claim 6 wherein said organic detergent builder is selected from sodium citrate and poly-acrylate/maleate copolymers of molecular weight ranging from about 5,000 to 100,000.

8. A composition according to claim 4 wherein said particulate material also comprises from about 1% to 25% by weight of the composition of an alkalinity source selected from water-soluble alkali metal carbonates, bicarbonates, borates, silicates and metasilicates.

9. A composition according to claim 8 wherein said alkalinity source is sodium carbonate.

10. A composition according to claim 4 which additionally contains from about 0.1% to 4% by weight of the composition of a chelating agent selected from amino carboxylates, phosphonates, amino phosphonates, polyfunctional substituted aromatic chelating agents and combinations of these chelating agents.

11. A composition according to claim 10 wherein said chelating agent is selected from diethylene triamine pentaacetic acid, ethylene diamine disuccinic acid, dipicolinic acid and hydroxyethyldiphosphonic acid and the salts of these chelating agents.

12. A composition according to claim 4 which additionally contains from about 0.001% to 5% by weight of the composition of enzyme prills wherein said prills range in size from about 100 to 1,000 microns, and wherein said enzyme is selected from proteases, amylases, cellulases, and lipases.

13. A composition according to claim 4 which additionally contains (A) from about 0.1% to 4% by weight of the composition of a thickening, viscosity control and/or dispersing agent selected from acrylic acid-based polymers having a molecular weight ranging from about 2,000 to 100,000; and/or (B) from about 0.01% to 5% by weight of the composition of an ethoxylated tetraethylenepentamine clay soil removal/anti-redeposition agent; and/or (C) from about 0.0001% to 2% by weight of a compatible brightener, suds suppressor, titanium dioxide, bleach catalyst, dye and/or perfume.

14. A non-aqueous, liquid, heavy-duty detergent with bleach composition in the form of a suspension of solid, substantially insoluble particulate material dispersed throughout a structured, surfactant-containing liquid phase, wherein:

A) said composition comprises from about 50% to 70% by weight of the composition of a structured, surfactant-containing liquid phase formed by combining:

i) from about 50% to 99% by weight of said liquid phase of non-aqueous liquids which comprise:

a) an alcohol ethoxylate component comprising $C_{10}$–$C_{14}$ alcohols containing from about 3 to 10 moles of ethylene oxide; and b) a non-aqueous organic solvent selected from diethylene glycol monobutyl ether, dipropylene glycol monobutyl ether, butoxy-propoxy-propanol and hexylene glycol;

in an alcohol ethoxylate to organic solvent weight ratio of from about 2:1 to 1:2; and ii) from about 1% to 50% by weight of said liquid phase of an anionic surfactant-containing powder which is formed by co-drying:

a) sodium $C_{10-14}$ linear alkyl benzene sulfonates; and b) one or more non-surfactant salts selected from sodium, calcium and magnesium sulfates;

to produce a powder which contains from about 45% to 94% by weight of said powder of said alkyl benzene sulfonic acid salts, from about 2% to 50% by weight of said powder of said non-surfactant salts and from about 0.5% to 4% by weight of said powder of residual water; and which contains from about 10% to 60% by weight of said powder of a solid phase which is insoluble in said non-aqueous liquids; and B) said composition also comprises additional particulate material which ranges in size from about 0.1 to 900 microns, and which is selected from i) particles of a peroxygen bleaching agent which is selected from sodium and potassium perborates and percarbonates; and which is present to the extent of from about 1% to 20% by weight of the composition;

ii) particles of a bleach activator which is selected from nonanoyloxybenzene sulfonate, (6-$C_8$–$C_{10}$ alkamido-caproyl) oxybenzene sulfonate and tetraacetyl ethylene diamine; and which is present to the extent of from about 1% to 10% by weight of the composition;

iii) particles of alkali metal carbonate; which is present to the extent of from about 2% to 15% by weight of the composition.

15. A composition according to claim 14 wherein said composition further comprises from about 1% to 10% by weight of the composition of particles of a bleach activator which can react with said peroxygen bleaching agent to form a peroxy acid.

16. A composition according to claim 15 which additionally contains from about 2% to 20% by weight of the composition or an organic detergent builder selected from alkali metal citrates, succinates, malonates, carboxymethylsuccinates, carboxylates, polycarboxylates, polyacetylcarboxylates and fatty acid soaps.

17. A composition according to claim 16 which additionally contains from about 2% to 15% by weight of an additional alkalinity source selected from water-soluble alkali metal bicarbonates, borates, silicates and metasilicates.

* * * * *